United States Patent [19]

Samoilov et al.

[11] Patent Number: 4,475,473

[45] Date of Patent: Oct. 9, 1984

[54] HAND-HELD EMBROIDERY MACHINE

[76] Inventors: Constantin Samoilov, 285 Brandywine Ct.; Miguel N. Samoilov, 1100 Orchard La., both of Woodburn, Oreg. 97071

[21] Appl. No.: 419,013

[22] Filed: Sep. 16, 1982

[51] Int. Cl.[3] ..... D05C 23/00

[52] U.S. Cl. ..... 112/80

[58] Field of Search ..... 112/169, 80, 121; 66/1.5, 2; 128/36

[56] References Cited

U.S. PATENT DOCUMENTS

| | | | |
|---|---|---|---|
| 854,147 | 5/1907 | Carillon et al. | 112/80 X |
| 1,932,516 | 10/1933 | Gilleland . | |
| 2,002,401 | 5/1935 | Kohanek . | |
| 2,077,719 | 4/1937 | Solliday . | |
| 2,517,627 | 8/1950 | Bombonato | 66/1.5 |
| 2,887,076 | 5/1959 | Sterner | 112/80 |
| 3,229,653 | 1/1966 | Roberts et al. . | |
| 3,380,413 | 4/1968 | Kuramochi | 112/277 X |
| 3,451,391 | 6/1969 | Tavel | 128/36 |

FOREIGN PATENT DOCUMENTS

| | | | |
|---|---|---|---|
| 2402811 | 7/1975 | Fed. Rep. of Germany | 112/80 |

*Primary Examiner*—Werner H. Schroeder
*Assistant Examiner*—Andrew M. Falik
*Attorney, Agent, or Firm*—Klarquist, Sparkman, Campbell, Leigh & Whinston

[57] ABSTRACT

A hand-held embroidery machine comprises an elongated cylindrical casing sized for grasping a user's hand and terminating in a truncated cone at the front end. A hollow embroidery needle protrudes from an opening in the front end of the cone. The rear end of the needle is received in a needle holder eccentrically mounted on a face gear which is in turn mounted inside the front end of the casing for rotation about an axis normal to the length of the casing. An electric motor is positioned in the casing rearwardly of the face gear with its output shaft normal to the axis of the face gear. A pinion gear on the shaft drives the face gear to reciprocate the needle. Operation of the motor is controlled by a three-position switch actuable by a pushbutton in a side of the casing rearwardly adjacent the cone for selectively driving the needle at different speeds. The casing has a rear end cap carrying a bracket for mounting a spool of thread on the casing. A channel guides thread forwardly from the spool along the outside of the casing to an opening leading into a front compartment housing the needle holder. Walls inside the compartment converge rearwardly from the eccentrically mounted needle to the opening for guiding a threading wire rearwardly from the needle holder to the channel. The rear end cap is removable to change batteries and the front compartment has a cap which is removable to change needles.

15 Claims, 6 Drawing Figures

HAND-HELD EMBROIDERY MACHINE

BACKGROUND OF THE INVENTION

This invention relates generally to embroidery and tufting machines and more particularly to hand-held such machines employing an eccentrically reciprocative hollow needle to insert loops of thread or yarn through a base fabric.

A hollow needle, through which thread or yarn is pulled, is conventionally employed in embroidery and in tufting or hooking rugs to manually insert loops of the thread or yarn through a base fabric. Embroidery in this manner requires substantial practice to become proficient and beginners often become discouraged. To facilitate forming large numbers of loops in a base fabric, several machines have been proposed.

U.S. Pat. Nos. 1,932,516 to Gilleland; 2,002,401 to Kohanek; and 2,077,719 to Solliday, disclose rug tufting devices in which a hollow needle is eccentrically driven for reciprocation of the needle lengthwise of the device. A guide member along the needle shaft at one end of the device provides a bearing or pivot point for pivoting the needle as it reciprocates so that the point of the needle traverses a closed tear-drop-shaped or generally elliptical path. These tools are driven manually by hand cranks, which is unsatisfactory for embroidering. It is difficult to accurately guide the tool with one hand while turning the crank with the other. In addition, the moving parts of each of these tools are exposed along the length of the tool, limiting the available positions at which the tool can be hand held to a handle positioned at the end of the tool opposite the needle. This arrangement makes close control of needle position, which is particularly important in fine embroidery, virtually impossible to achieve.

U.S. Pat. No. 3,229,653 to Roberts, et al. discloses a portable tufting machine which incorporates means for powering the needle reciprocation and drive mechanism from an external power source via a flexible rotating shaft or cable. Such a powering means is unsatisfactory, particularly for an embroidery machine, because the cable interferes with maneuvering of the tool over the workpiece and also ties the user to the proximity of the power source. It would be preferable to drive such a machine without need for a stiff cable and, better yet, to dispense altogether with any form of connection to an external power source. Apart from the foregoing drawbacks, the Roberts, et al. machine is also bulky and, utilizing a pistol grip handle remote from the needle, is difficult to control.

Accordingly, a need remains for a convenient hand-held machine for inserting loops of thread or yarn into a base fabric and, more particularly, for such a powered embroidery machine adapted for precise control of the needle.

SUMMARY OF THE INVENTION

One object of the invention is to provide a hand-held machine suitable for use in fine embroidery.

A second object of the invention is to improve machines used for inserting loops of thread or yarn into base fabric.

Another object of the invention, as aforementioned, is to streamline such machines for ease of handling and maximum control during operation.

A further object is to drive such machines with a self-contained power source.

Yet another object of the invention is to variably control the speed of operation of such machines.

Additional objects of the invention include:

(1) to provide a hand-held, self-powered embroidery machine which enables people with little or no embroidery skill to do fine embroidery;

(2) to enable quick, easy change of needles in such machines; and (3) to facilitate the threading of such machines.

In accordance with the invention, the foregoing objects are fulfilled in an embroidery machine arranged in an elongated casing for easy hand-held operation. A hollow, reciprocative needle is positioned at one end of the casing, referred to herein as the "front" or "needle" end, which is preferably conical in shape. Housed within the casing rearwardly of the needle is a needle-drive means, including a prime mover and a drive train powered by the prime mover for driving the needle point in a closed, generally elliptical path. Proceeding rearwardly from the needle, the drive means preferably comprises a face gear, means eccentrically mounting the hollow needle on the face gear, and electrical motor means having a rotational output shaft extendng lengthwise of the casing and mounting a pinion gear for driving the face gear. The motor means can include a push-button variable-speed power switch on a side of the casing near the needle. Preferably, the motor means comprises a DC electric motor powered by batteries positioned inside the casing. A snap-in spool holding means is positioned externally at the rear end of the casing. Thread or yarn from the spool extends forwardly along the casing into the needle, preferably guided in a channel along the outside of the casing and entering the casing via an entrance rearwardly adjacent the needle. The entrance can include guiding means positioned inside the casing for guiding thread rearwardly from the needle through the entrance and outwardly to the channel to facilitate threading. The casing is preferably divided longitudinally and transversely to form a removable needle cap and the rear end of the needle is mounted in a needle holder comprising a post rotatably received in a hole in the face gear for easy interchangeability.

The foregoing and other objects, features and advantages of the invention will become more readily apparent from the following detailed description of a preferred embodiment which proceeds with reference to the accompanying drawings.

DETAILED DESCRIPTION OF A PREFERRED EMBODIMENT

Figure 1:
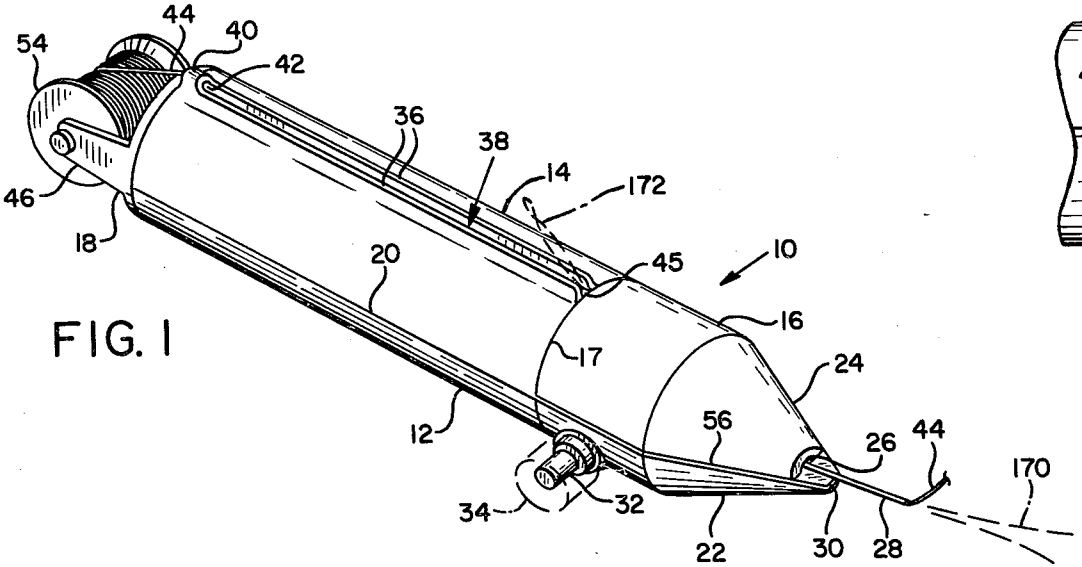
FIG. 1 is a perspective view taken from the top, front and one side of an embroidery machine according to the invention.
Figures 5, 6:
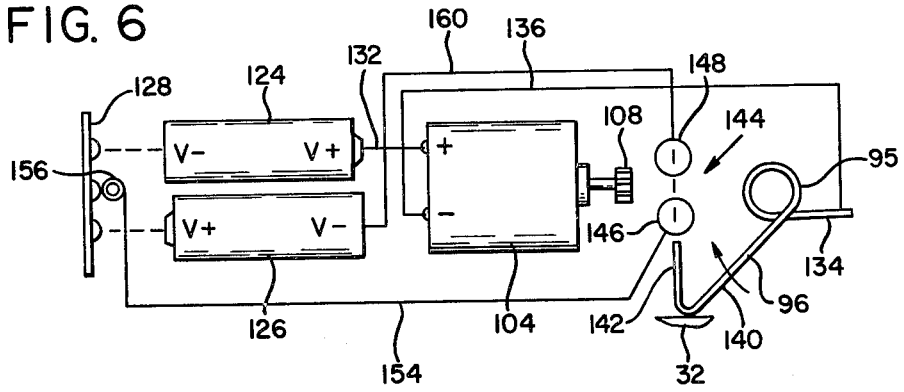
FIG. 5 is an exploded perspective view of the machine of FIG. 1.
FIG. 6 is a diagram of the electrical wiring of the machine of FIGS. 1-5.

Referring to FIGS. 1 and 5, an embroidery machine 10 has an elongated cylindrical casing having a conical front end and comprising a lower half 12, an upper half 14, needle cowling or cap 16, and a rear end cap 18. The upper and lower halves of the casing are separable along a longitudinal dividing plane 20 and the needle cap 16 is separable from the upper casing half 14 along transverse dividing line 17.

The front or needle end of the lower half of the casing terminates in a blunt cone 22. The needle cap 16 similarly terminates in a half cone 24, which is symmetrical about dividing line 20 with cone 22, but is truncated near its front end to provide a central opening 26 for hollow embroidery needle 28. A blunt underhung portion at the front end of lower casing half 12 extends forwardly from opening 26 to provide a needle depth gauge 30. A switch button 32 is positioned in a side of lower casing half 12 rearwardly adjacent cone 22. A switch cover 34 encloses button 32 when the machine is not in use.

Top casing half 14 has lower margins 15 which are recessed to nest within complementary formed upper margins 13 of lower casing half 12 to assemble the casing. The casing halves are rearwardly open at their rear ends, and end cap 18 has a recessed axially-extending annular flange 19 sized for insertion into the rear end of the assembled casing. A pair of radially extending posts 21 are positioned on opposite sides of flange 19 to fit into L-shaped locking grooves 23 formed inside the upper and lower casing halves. A pair of parallel flanges 46, 48 extend rearwardly from the end cap. These flanges have rearwardly opening notches 50 in their rearmost ends for receiving a spindle 52, on which is mounted a spool 54 for thread 44.

Two parallel, closely spaced ridges 36 along the top of the upper casing half 14 form a channel 38 extending lengthwise of the casing for guiding thread 44 from the spool on end cap 18 to the needle 16. Spanning the rear end of the channel is an arch 40 forming, together with the channel, an eye 42 for guiding thread or yarn 44 forwardly into the channel. The thread enters the needle cap via opening 45 along dividing plane 17.

Figure 3:
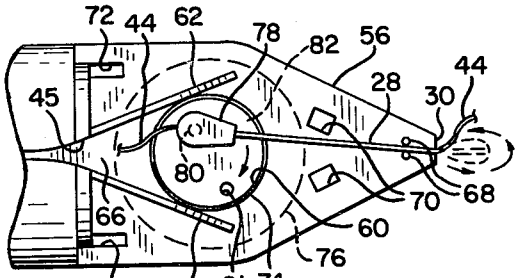
FIG. 3 is a top plan view of the front end of the machine of FIG. 1 with the needle cap removed to show further details of assembly.
Figure 4:
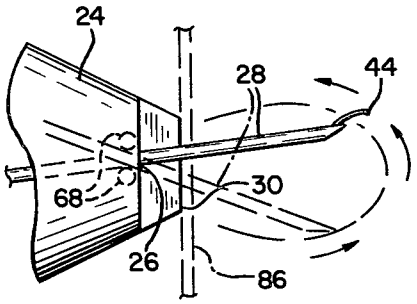
FIG. 4 is an enlarged top plan view of the needle end of the machine of FIG. 1 showing operation of the machine.

Referring to FIGS. 3, 4 and 5, needle cap 16 encloses a needle platform 56, which is integrally formed with upper casing half 14. Platform 56 extends parallel to plane 20 forwardly from a transverse casing wall 58 at plane 17 so as to longitudinally divide a front portion of the casing into upper and lower compartments. A circular opening 60, centered on axis 61 in platform 56 and spaced approximately the length of the needle from the end of depth gauge 30, communicates between the two compartments.

Within the upper compartment, a pair of vertical wings 62, 64 extend forwardly along platform 56 from wall 58, diverging from opening 45 so as to partially enclose opening 60. A ramp 66, formed in the back wall between wings 62, 64, slopes upwardly toward wall 58 from the rearward edge of opening 60 to opening 45. In front of opening 60, a pair of spaced apart posts 68 are positioned normal to platform 56 a short distance rearwardly of depth gauge 30 and on opposite lateral sides of opening 26. A pair of forward catch openings 70 and a pair of rear catch openings 72 in the platform receive complementary tabs 74, 76 extending downwardly from the inner surface of the needle cap to secure the needle cap to the platform.

A needle drive disc 74, mounted on top of a face gear 76, is received upwardly through opening 60 from the lower compartment. A needle holder 78 is eccentrically positioned on disc 74 in the upper compartment and pivotally connected to the disc by means of a downwardly extending post 79 fitted loosely into a complementary off-axis hole 81 in disc 74. An alternate off-axis hole 81 is positioned at a greater distance from axis 61 than hole 80 for increasing the eccentricity for a longer needle and thus increasing the size of the loops formed in the base fabric. Hole 81 can be larger than hole 80 for receiving a larger post (not shown) to facilitate correct placement of a longer needle so that its point is withdrawn the same distance rearwardly of the depth gauge as is the point of needle 28 during operation.

A cylindrical passageway 82 extends rearwardly through the needle holder. The rear end of needle 28 is snugly received in passageway 82 and the front end of the needle is positioned between posts 68. A cylindrical member 84 concentric with disc 74 depends from needle cap 16 to a position spaced closely above needle holder 78 to engage and thereby retain the needle holder in the disc as it rotates.

Upon rotation of disc 74 in a clockwise direction, the end of needle 28 moves in and out of opening 26 and, pivoting on posts 68, moves counterclockwise so that the point of the needle traverses a teardrop-shaped or generally elliptical path, as shown in FIG. 4. When depth gauge 30 is positioned against a layer of base fabric 86, this action causes a loop of yarn or thread 44 to be inserted through the fabric. At the same time, the lateral movement of the needle urges the machine laterally along the base fabric to space successive loops in a line.

Figure 2:
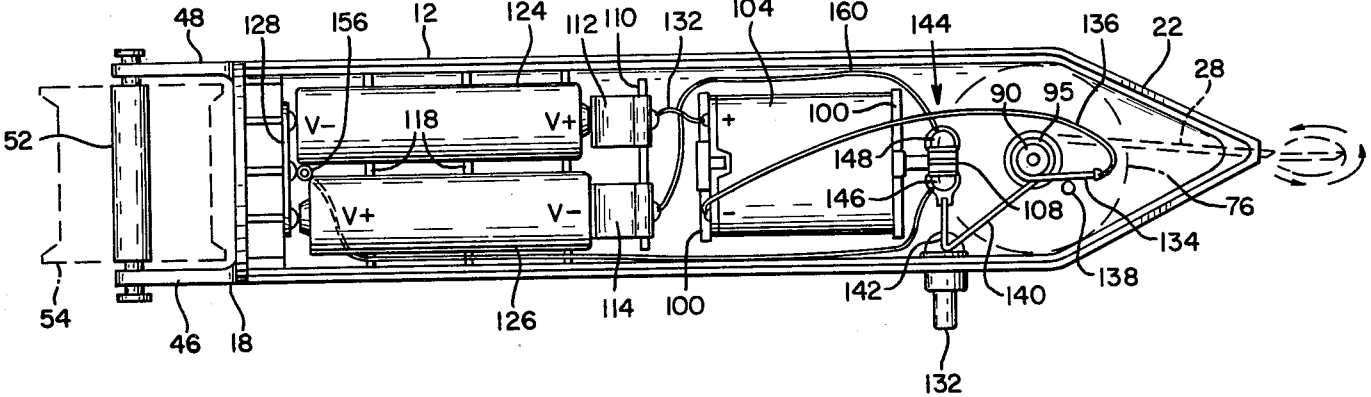
FIG. 2 is a top plan view of the machine of FIG. 1, the upper half of the casing and the needle drive cowling being removed and the needle and drive assembly being shown in phantom lines to show details of assembly.

Referring now to FIGS. 2 and 5, face gear 76 is supported in the lower compartment on a cylindrical post 90 extending upwardly from the bottom of lower casing half 12 into a central opening 92 in the gear. A washer 94 and a circular loop 95 of a spring 96 are also received on post 90 and supported in abutting contact with the lower face of gear 76 by a thickened annular base portion 98 of post 90. Spring 96 is further described below.

Spaced rearwardly of post 90 are a pair of shallow, semi-circular partitions 100 forming, together with an arcuate partition 102 depending from the upper casing half, motor mounts for a cylindrical D.C. electric motor 104. Motor 104 has an output shaft 106 extending lengthwise of the casing forwardly beneath gear 76 and radially of the gear. A pinion gear 108 mounted on the output shaft meshes with teeth on the lower face of gear 76.

A third partition 110 is positioned in the lower casing half behind motor 104. Mounted on partition 110 are two electrically separate, spring contact battery terminals 112, 114. Spaced rearwardly of partition 110 are three partitions 118, each having a pair of semi-circular notches 120 along their upper edge. Together with three like partitions 122 depending from the top casing half, these partitions provide means for mounting two batteries 124, 126 lengthwise in the casing, with their frontwardly facing ends abutting contacts 112, 114, respectively. A triangular contact plate 128, supported on posts 130 in end cap 18, is positioned to abut the rearwardly facing ends of the batteries and to form an electrical connection therebetween.

Referring to FIGS. 2, 5 and 6, motor 104 is powered by batteries 124, 126 through an electrical circuit and switch arrangement operable by pushbutton 32 to run the embroidery machine at two different speeds. The positive pole of battery 124 is connected to the positive pole of motor 104 via conductor 132. Spring 96, forming a portion of the electrical circuit, is connected at its front leg 134 via conductor 136 to the negative pole of motor 104. Leg 134 is prevented from rotating clockwise around post 90 by a post 138 radially spaced forwardly and to one side of post 90. The opposite end of loop 95 extends in a diagonal leg 140 rearwardly to button 32 and terminates in a dog leg 142 and an acute angle directed toward the center of the lower casing half. The distal end of leg 142 is connected to a three-position switch 144.

Switch 144 includes a pair of contacts 146, 148 supported on posts 150, 152 projecting upwardly from the bottom of lower casing half 12. Contact 146 is connected via a conductor 154 to a coil spring 156 mounted on a post 158 projecting upwardly from the bottom of the lower casing half in position for spring 156 to conductively contact plate 128. Contact 148 is connected through conductor 160 to battery contact 114 and thereby to the negative pole of battery 126.

The batteries are positioned in the casing so that they are electrically connected in series through plate 128. As long as button 32 remains undepressed, the electric circuit in motor 104 is open. When the button is pressed in half way, the circuit is closed at contact 146, enabling current to flow through conductor 154, drawing only from battery 124 to drive the motor and thereby the needle at a first speed. Fully depressing button 32 breaks the conductive connection at contact 146 and makes a connection at contact 148, allowing current to flow through plate 128 and conductor 160 to drive the motor and needle at a second, faster speed.

OPERATION

To operate machine 10, end cap 18 is removed and batteries 124, 126 are installed. The end cap is then reinserted into the open end of the casing and turned to lock posts 21 in grooves 23. Next, a spool 54 of thread 44 is selected, placed on spindle 52, and the ends of the spindle are snapped into semi-circular openings 50 in the spindle bracket 46. The spool should be oriented so that thread is stripped forwardly from the top of the spool. An end of the thread is passed through eye 42 and pulled forwardly along channel 38 toward opening 45. Referring to FIG. 1, a conventional threading wire 170 is inserted into the end of needle 128 and pushed rearwardly through the needle. As the leading end 172 of the wire passes rearwardly through the needle holder 78, wings 62, 64 and ramp 68 guide it rearwardly toward and through opening 45. An end of the thread 44 is then passed through a loop in the end 172 of wire 170, and the wire is withdrawn from the needle, pulling the thread forwardly along with it.

To embroider base fabric 86, the machine 10 is positioned with depth gauge 30 against the surface of the fabric, as shown in FIG. 4. The machine is grasped in the user's hand with the user's thumb poised over button 32. Button 32 is then pushed to a first or half-depressed position, closing electrical circuit at contact 146, to drive motor 104 from battery 124 at the aforementioned first speed. Shaft 106 is thereby caused to rotate pinion gear 108, which, meshed with face gear 76, turns disc 74 to eccentrically reciprocate needle holder 78. This action causes the needle to move in and out of opening 26, to insert loops of thread 44 through the fabric, and laterally, to self-propel the machine along the fabric. To operate machine 10 faster, button 32 is fully depressed to close contact 148.

The convenient shape of machine 10 and its small, compact size, preferably about 8 inches long by 1½ inches in diameter, enable the machine to be easily guided along the surface of the fabric in any desired direction to form patterns of loops in the fabric. The machine can be held in one hand, leaving the user's other hand free to manipulate the fabric. When a corner or other shape requiring greater precision is to be formed, the user can partially release button 32, allowing the speed of the machine 10 to slow down to its slower first speed. Accordingly, even an unskilled embroiderer could readily use this machine to quickly make uniform loops in a base fabric.

When spool 54 runs out of thread, or a change in thread color or size is desired, it can be quickly snapped out of its holder and replaced with a new spool. To replace needle 28, needle cap 16 is easily removed by squeezing its sides to release tabs 74, 76. Needle holder 78 is then removed from hole 79, and a new needle in its own needle holder is installed in either hole 80 or 81 depending on the desired eccentricity and length of needle. Cap 16 is then replaced and the needle is rethreaded using wire 170, as described above.

Having described and illustrated the principles of our invention in a preferred embodiment, it should be apparent to those skilled in the art that the invention may be modified in arrangement and detail without departing from such principles. For example, the face and pinion gears could each be bevel gears. We claim all modifications coming within the scope and spirit of the following claims.

We claim:

1. A hand-held, self-powered generally cylindrical embroidery machine comprising:

a casing having a front end and a rear end;

an embroidery needle drive means mounted within said casing, said drive means including a prime mover and a drive train positioned forwardly of the prime mover for driving the point of an embroidery needle in a closed, generally elliptical path;

needle-mounting means for connecting an embroidery needle to said drive train so that the point of said needle protrudes from said front end;

the casing comprising an elongated cylinder including a cylindrical gripping portion rearwardly adjacent the needle and sized to fit within a user's hand between the thumb and index finger and a finger-actuable switch means positioned adjacent the front end of the casing for operating the drive means.

2. A machine according to claim 1 in which the casing includes means for mounting a spool of thread at the rear end of the casing and means defining a conduit for guiding thread forwardly from the rear end of the casing to the needle-mounting means.

3. A machine according to claim 1 in which the drive train includes rotatable crank means positioned forwardly of prime mover in casing means for pivotally mounting said needle-mounting means to said crank means eccentrically of an axis of rotation of crank means, and pivot means positioned forwardly of the crank means in the front end of the casing for receiving a needle shaft and enabling the shaft to pivot rearwardly of the point of the needle.

4. A machine according to claim 1 in which:

said drive train includes a first gear mounted within the front end of the casing for rotation about an axis normal to the length of the casing, means eccentrically mounting the needle-mounting means on the first gear, and a second gear drivably engaging the first gear; and the prime mover includes motor means positioned rearwardly of the first gear and having an output shaft mounting the second gear for rotation about an axis extending lengthwise of the casing for driving the first gear.

5. A hand-held, self-powered generally cylindrical embroidery machine comprising:

a casing having a front end and a rear end;

an embroidery needle drive means mounted within said casing, said drive means including a prime mover and a drive train positioned forwardly of the prime mover for driving the point of an embroidery needle in a closed, generally elliptical path; and needle-mounting means for connecting an embroidery needle to said drive train so that the point of said needle protrudes from said front end;

the casing comprising an elongated cylinder including a cylindrical gripping portion rearwardly adjacent the needle and sized to fit within a user's hand between the thumb and index finger, the front end of the casing terminating in a cone which is transversely truncated at said front end to define an opening for the needle and including means integrally formed in the front end of the casing and extending forwardly from said front end parallel to the needle to define a depth gauge for spacing the needle a predetermined distance from a base fabric.

6. A hand-held, self-powered generally cylindrical embroidery machine comprising:

a casing having a front end and a rear end;

an embroidery needle drive means mounted within said casing, said drive means including a prime mover and a drive train positioned forwardly of the prime mover for driving the point of an embroidery needle in a closed, generally elliptical path; and needle-mounting means for connecting an embroidery needle to said drive train so that the point of said needle protrudes from said front end;

the casing comprising an elongated cylinder including a cylindrical gripping portion rearwardly adjacent the needle and sized to fit within a user's hand between the thumb and index finger;

the drive means including a power source positioned within said casing rearwardly of the prime mover;

the power source comprising storage battery means and the prime mover comprising an electric motor, electric circuit means operably interconnecting the motor and battery means, and a variable-speed switch means in said circuit for controlling the speed of said motor and thereby driving the needle at different speeds.

7. A hand-held, self-powered embroidery machine comprising:

a casing having a front end and a rear end;

an embroidery needle drive means mounted within said casing, said drive means including a prime mover and a drive train positioned forwardly of the prime mover for driving the point of an embroidery needle in a closed, generally elliptical path;

needle-mounting means for connecting an embroidery needle to said drive train so that the point of said needle protrudes from the front end of the casing;

means for mounting a spool of thread in the casing remotely of the front end of the casing;

means defining a thread channel extending lengthwise along the outside of the casing;

an opening in the casing communicating with a front end of the channel for guiding thread from the channel into the casing toward the needle-mounting means; and guide means within a forward portion of said casing for guiding a threading wire passed through a needle-mounting means rearwardly within said forward portion through said opening.

8. A machine according to claim 7 in which the drive train includes means positioned in the forward portion of the casing for eccentrically rotating the needle-mounting means and the guide means includes walll means within said forward portion extending rearwardly from the eccentric rotating means and converging toward said opening to direct the threading wire therethrough.

9. A hand-held, self-powered embroidery machine comprising:

a casing having a front end and a rear end;

an embroidery needle drive means mounted within said casing, said drive means including a prime mover and a drive train positioned forwardly of the prime mover for driving the point of an embroidery needle in a closed, generally elliptical path; and needle-mounting means for connecting an embroidery needle to said drive train so that the point of said needle protrudes from the front end of the casing;

the needle-mounting means including:

a needle holder body including parallel flat upper and lower sides and means defining a hole extending front to rear through the needle holder body parallel to said sides;

a hollow embroidery needle having a rear end received in said hole in the front of the needle holder body;

a cylindrical post extending downwardly from the needle holder body normal to the lower side; and a disc mounted in the front end of the casing for rotation by said drive train about an axis normal to the needle, the disc including means defining a cylindrical hole parallel to and offset from said axis for rotatably receiving said post to eccentrically mount the needle holder body thereon.

10. A machine according to claim 9 in which said casing includes a removable casing portion for housing the needle-mounting means and disc, the casing portion including means for engaging the upper side of the needle holder body to retain it on the disc during rotation, the needle holder body being freely removable from the disc when the casing portion is removed.

11. A machine according to claim 9 in which the rotating disc includes two of said cylindrical holes positioned at different radii.

12. A hand-held, self-powered embroidery machine comprising:

an elongated casing sized to fit within a user's hand, said casing having a front end and a rear end which encloses a drive means and prime mover;

an embroidery needle drive means mounted within said casing, said drive means including a prime mover and a drive train positioned forwardly of the prime mover for driving the point of an embroidery needle in a closed, generally elliptical path; and needle-mounting means for connecting an embroidery needle to said drive train so that the point of said needle protrudes from the front end of the casing; in which:

the casing comprises an elongated cylindrical casing terminating in a truncated cone defining said front end;

the drive train includes a face gear mounted in said front end for rotation about an axis normal to the length of the casing;

the needle-mounting means comprises means for eccentrically mounting a rear end of a hollow embroidery needle on the face of the face gear with its point protruding from an opening in the front end of the casing; and the prime mover comprises an electric motor means positioned within the casing rearwardly of the face gear; the motor means including a rotational output shaft extending normal to the axis of rotation of the face gear, a pinion gear mounted on the shaft for driving the face gear to reciprocate the needle, and switch means including a pushbutton in a side of the casing rearwardly adjacent the cone for selectively powering the motor means to reciprocate the needle at different speeds.

13. A powered embroidery machine comprising:

needle drive means for reciprocating an embroidery needle;

electric motor means for driving the needle drive means;

electric power means for powering the motor through an electrical circuit; and means including a switch in said circuit for selectively driving the motor means at two different speeds; in which the power means comprises two batteries connected in series, the switch is a three-position switch, and the circuit is arranged so that a first switch position applies no power to the motor means; a second switch position applies power of only one of the batteries to the motor means, and a third switch position applies power of both batteries to the motor means.

14. A powered embroidery machine comprising:

needle drive means for reciprocating an embroidery needle;

electric motor means for driving the needle drive means;

electric power means for powering the motor through an electrical circuit;

means including a switch in said circuit for selectively driving the motor means at two different speeds; and a casing enclosing the machine with the needle protruding therefrom;

a pushbutton means in a side of the casing manually depressible for actuating the switch; and spring means within the casing biasing the pushbutton means to an undepressed first position for deactuating the switch and yieldable to enable progressively depressing the pushbutton means to second and third depressed positions to actuate the switch for driving motor means at said two speeds, the speed increasing with extent of depression of the pushbutton means.

15. A hand-held, self-powered embroidery machine comprising:

a casing having a front end and a rear end which encloses a drive means and prime mover;

an embroidery needle drive means mounted within said casing, said drive means including a prime mover and a drive train positioned forwardly of the prime mover for driving the point of an embroidery needle in a closed, generally elliptical path;

needle-mounting means for connecting an embroidery needle to said drive train so that the point of said needle protrudes from said front end; and means defining a depth gauge at the front end of the casing for spacing the point of the needle a predetermined distance from a base fabric when withdrawn from the fabric;

the drive train including eccentric means mounted for rotation about an axis spaced a predetermined distance D from the depth gauge;

the needle mounting means including means for interchangeably connecting first and second embroidery needles of different lengths L and L′ to the eccentric means at first and second radii, R and R′ respectively, from said axis, such that L is proportional to D+R and L′ is proportional to D+R′ for driving said different length needles at different eccentricities so that the point of each needle is withdrawn to substantially the same predetermined distance from the base fabric.

* * * * *